US010076177B2

(12) United States Patent
Li et al.

(10) Patent No.: US 10,076,177 B2
(45) Date of Patent: Sep. 18, 2018

(54) COMPRESSION SYSTEM FOR BACKPACK

(71) Applicants: Kaitlynn Li, Plano, TX (US); Pei Li, Plano, TX (US)

(72) Inventors: Kaitlynn Li, Plano, TX (US); Pei Li, Plano, TX (US)

( * ) Notice: Subject to any disclaimer, the term of this patent is extended or adjusted under 35 U.S.C. 154(b) by 151 days.

(21) Appl. No.: 14/815,048

(22) Filed: Jul. 31, 2015

(65) Prior Publication Data

US 2016/0029775 A1 Feb. 4, 2016

Related U.S. Application Data

(63) Continuation-in-part of application No. 13/931,859, filed on Jun. 29, 2013, now Pat. No. 9,125,478.

(60) Provisional application No. 61/742,728, filed on Aug. 17, 2012, provisional application No. 61/690,445, filed on Jun. 29, 2012.

(51) Int. Cl.
*A45F 3/04* (2006.01)

(52) U.S. Cl.
CPC ..... *A45F 3/04* (2013.01); *A45F 3/047* (2013.01)

(58) Field of Classification Search
CPC ..... A45F 3/04; A45F 3/047
USPC ..... 224/627, 630, 631, 642, 644, 645, 586, 224/578–579
See application file for complete search history.

(56) References Cited

U.S. PATENT DOCUMENTS

| | | | | | |
|---|---|---|---|---|---|
| 5,431,317 | A * | 7/1995 | Kliot | A45F 3/02 | 224/153 |
| 5,503,314 | A | 4/1996 | Fiscus | | |
| 5,567,084 | A | 10/1996 | Oliver | | |
| 5,573,155 | A * | 11/1996 | Sadler | A45F 4/02 | 224/153 |
| 5,762,243 | A | 6/1998 | McMaster | | |
| 5,957,355 | A | 9/1999 | Swetish | | |
| 6,070,776 | A | 1/2000 | Furnary et al. | | |
| 6,164,509 | A * | 12/2000 | Gausling | A45F 3/047 | 224/153 |
| 6,179,187 | B1 * | 1/2001 | Lemire | A45F 3/04 | 224/153 |
| 7,204,399 | B2 | 4/2007 | Collier | | |
| 7,726,530 | B1 | 6/2010 | Exposito | | |
| 2005/0017041 | A1 * | 1/2005 | Roberts | A45F 3/04 | 224/642 |

(Continued)

*Primary Examiner* — Adam Waggenspack
(74) *Attorney, Agent, or Firm* — Edwin S. Flores; Daniel J. Chalker; Chalker Flores, LLP

(57) ABSTRACT

A compression system for an ergonomic backpack is disclosed. The backpack includes a backpack body having a top side, a bottom side, two lateral sides, a body side, an outer side and a pair of shoulder straps. In the embodiment, each shoulder strap is connected at a junction of the top side and the body side, extended along the corresponding lateral side, threaded through the D-ring with a distal end connected to the backpack body at a junction of the outer side and the lateral side. The invention also comprises an optional back panel and an optional back support device, secured to the body side. The back panel and support device may be filled with padding material such as a gel, foam, rubber, fluid or the like. When the user ties the two straps, the backpack is automatically compressed and moves closer to the user's back The system, operated like a regular two-strap backpack, allows the user to carry heavier loads for a longer period of time with less fatigue.

10 Claims, 7 Drawing Sheets

(56) References Cited

U.S. PATENT DOCUMENTS

| | | | |
|---|---|---|---|
| 2005/0092803 | A1 | 5/2005 | Collier et al. |
| 2008/0179364 | A1 | 7/2008 | Thatcher |
| 2014/0008404 | A1 | 1/2014 | Li |

* cited by examiner

COMPRESSION SYSTEM FOR BACKPACK

PRIORITY

This application claims priority to, and is a continuation-in-part application of, U.S. Ser. No. 13/931,859, filed Jun. 29, 2013, which claims priority to U.S. Provisional Patent Application Ser. No. 61/690,445 filed on Jun. 29, 2012 and U.S. Provisional Patent Application Ser. No. 61/742,728, filed on Aug. 17, 2012, the entire contents of which are incorporated herein by reference.

BACKGROUND OF THE INVENTION

1. Field of the Invention

The present invention relates generally to backpacks, and more particularly, to ergonomic backpacks having a compression system that compresses the contents of the backpack. The system, operating like a regular backpack, allows the user to carry heavier loads for a longer period of time with less fatigue and discomfort.

2. Description of Related Art

The use of backpacks for carrying loads for different purposes is well known. In recent years, the popularity of the backpack for daily use has increased significantly. Students, for example, use backpacks to carry their school related materials. Hikers use backpacks to carry hiking gear, food and drinks Young professionals use backpacks to carry their documents, computers, etc.

While regular backpacks are suitable for carrying loads, they are not suitable for carrying heavy loads. Even so, students have to use backpacks to carry heavy loads relative to their body weights to school every day in order to bring the necessary school supplies and books.

A serious disadvantage of the backpacks normally used by students when carrying heavy loads is discomfort to the user's lower back, which could potentially lead to body damage. In theory, the best placement of the load of a backpack is immediately above the human body center of the pelvis, as illustrated in FIG. 2B, which shows an ergonomic backpack with a load that is closer to the user's back and has a slightly higher center of gravity ("CG"). However, a conventional backpack sags with the load, which causes the load not only to move further away from the user's back but also to shift the center of the gravity below the human body center of the pelvis as shown in FIG. 2A. This creates stronger downward moment and makes the backpack feel much heavier to the user. Furthermore, the sagging of the backpack, results in the user's back loosing proper and comfortable support. As a result, the user cannot maintain proper back position and has to lean forward when carrying heavy loads for a while. Anyone who has seen students walking across a campus has witnessed the negative sagging effect of the backpack on students' postures. Once the spine alignment is improper and the muscles become stressed, the user feels discomfort, fatigue and pain, which could even result in injury to the back Tills can be more harmful for younger students because frequent improper spine alignment caused by carrying heavy backpacks every day could potentially lead to poor posture problems.

Therefore, it is highly desirable to design an improved backpack, which is configured to be more comfortable when carrying a relatively heavy load. Whereas considerable efforts have been emphasized on new technologies in manufacturing backpacks, relatively less has been done to address the sagging effects of backpacks. U.S. Pat. No. 6,164,509 to Gausling et al. discloses a backpack with a compression system and an optional back support device. The system uses straps to reduce the sagging effect by pulling the backpack closer to the user's body. However, the complicated construction could increase manufacturing costs, which limits its implication in practice. Michael Collier et al. disclose a different compression system using straps in U.S. Pat. No. 7,204,399. In Collier's invention, each shoulder strap has a first end connected at a junction of the top side and the body side, and a second end connected to the backpack body at a junction of the bottom side and the body side. Each of the straps extend through the bottom of the backpack, thread through a D-ring attached to the lateral side and the outside, pass through the lateral side, and then thread through a second D-ring attached to the lateral side and the body side. When the straps are tied, the backpack is lifted and moved toward the back of the user. However, due to the extended strap being used in the process of lifting and compression, the user has to further pull down the straps in order to complete the process.

Reducing the sagging effect of a backpack may not automatically bring adequate back support to the user. Both the inventions discussed above and many others in the prior art do not provide a simple and effective way to jointly address the sagging and back support issues.

The instant invention results from a methodical attempt to resolve the above disadvantages of the backpack of the prior art.

SUMMARY OF THE PRESENT INVENTION

The principal object of present embodiment is to provide an improved backpack that can carry a heavy load with minimal discomfort. This and other useful objectives are achieved by using a simple compression system for a backpack. The backpack includes a backpack body having a top side, a bottom side, two lateral sides, a body side, an outer side and a pair of shoulder straps. In the embodiment, each shoulder strap is connected at a junction of the top side and the body side, extended along the corresponding lateral side, threaded through the D-ring with a distal end connected to the backpack body at a junction of the outer side and the lateral side.

When the user simply ties the two straps, the backpack is automatically compressed and moved closer to the user's back with the optional back support device that can be pressed toward the user's back when pulling the straps, the user feels even stronger support on the back after compressing. The system allows the user to carry heavier loads for a longer period of time with less fatigue, thus reducing discomfort, poor posture, and even musculo skeletal disorder and injury.

DESCRIPTION OF THE DRAWINGS

For a better understanding of the present invention and further features thereof, reference is made to the following description which is to be read in conjunction with the accompanying drawing wherein.

DESCRIPTION OF CERTAIN PREFERRED EMBODIMENT OF THE INVENTION

Figure 1:
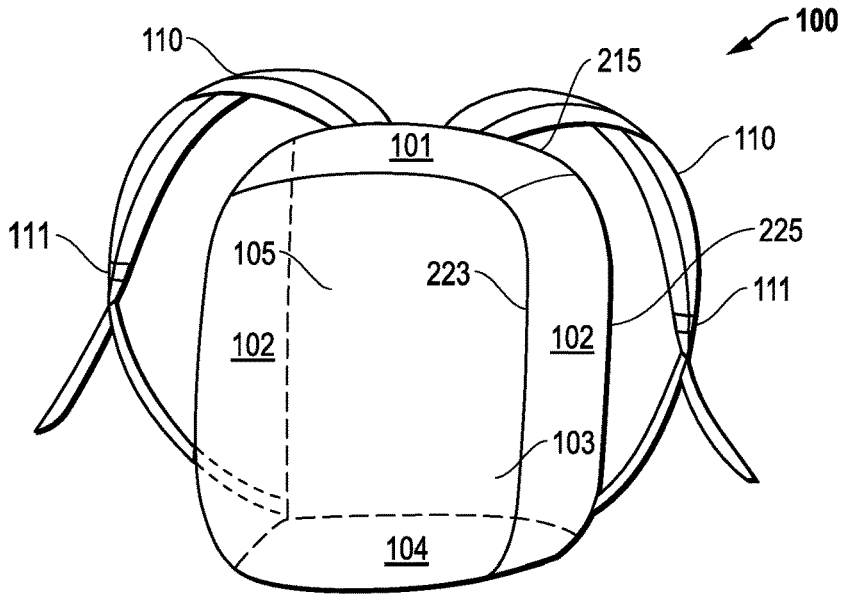
FIG. 1 (Prior Art)
FIG. 1 is a perspective view of a conventional backpack of prior art.
Figure 2A:
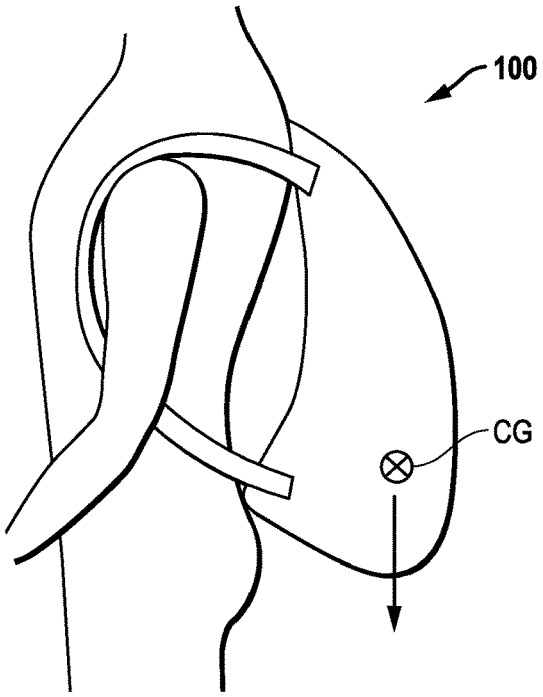
FIG. 2A is a side view of a conventional backpack shown as worn.
Figure 2B:
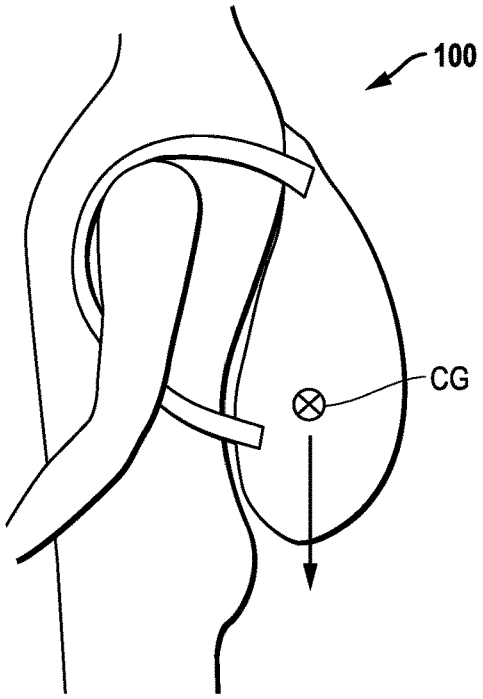
FIG. 2B is a side view of an ergonomic backpack shown as worn.

A conventional backpack body 100 of the prior art, shown in FIG. 1, is formed by a top side or region 101, two lateral sides or regions 102, an outer side or region 103, a body side or region 105, a bottom side 104 and a pair of shoulder straps 110. When connected, theses six sides or regions define an interior compartment called the body into which cargo such as books, food, etc. can be stowed. It is understood that this region may be subdivided into or complemented with a number of additional compartments or regions for keeping various items separate. Separating the two sides or regions are junctions or seams. Three junctions used later in the text are defined. The first junction 215 is defined between the top side 101 and the body side 105. The second junction 223 is defined between the lateral side 102 and the outer side 103. The third junction 225 is defined between the lateral side 102 and the body side 105. The defined junctions help readers in understanding the relative location on the body being discussed. The system, operated like a regular two-strap backpack, allows the user to carry heavier loads for a longer period of time with less fatigue, thus reducing discomfort, poor posture, and even musculoskeletal disorder and injury.

Although the six-side configuration of 100 is described, the backpack body can have fewer sides or regions and correspondingly fewer junctions or seams and still be within the scope of the invention. The particular six-side configuration and junctions are described herein strictly to assist the reader in understanding the embodiments of the invention.

The description of junctions is meant to define a general transition region. One may move as many as several inches away from the first junction 225, for example, into the region of the outer side or the lateral side or anywhere along the line shown in the figure as defining the junction, and still be within the scope of invention.

Figure 3:
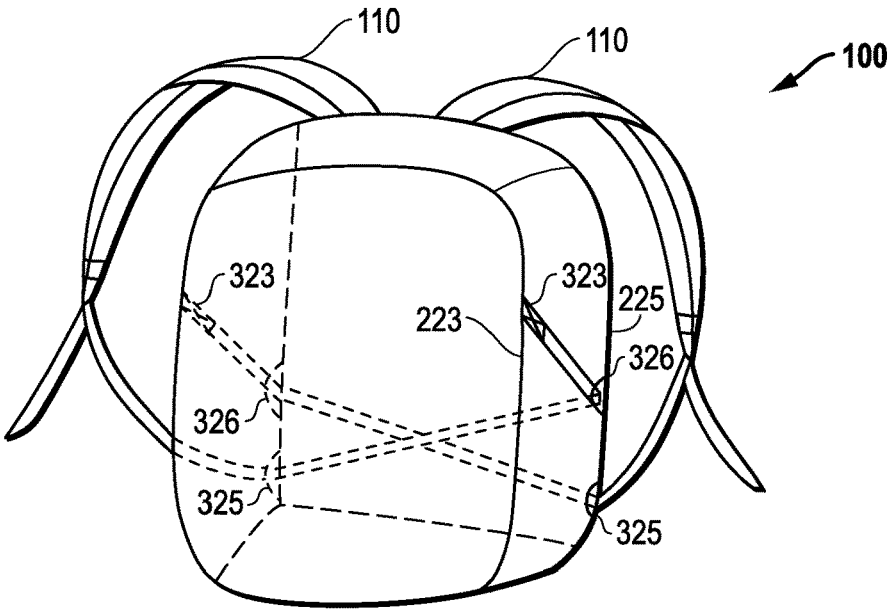
FIG. 3 is a perspective view of a backpack according to the embodiment of the present invention.

In FIG. 3, backpack 100 with the compression system of the embodiment of the invention is formed by a flexible or solid material such as plastic, canvas, cloth or other suitable material and by a top side or region 101, two opposed lateral sides or regions 102, an outer side or region 103, a body side or region 105, a bottom side 104 and a pair of shoulder straps 110. The top side may be connected to the two lateral sides 102, the outer side 103 and the body side 105, and the bottom side 104 may be connected to the two lateral sides 102, the outer side 103 and the body side 105. The two lateral sides 102 may be connected to the top side 101, the bottom side 104, the body side 105 and the outer side 103. The body side 105 may be connected to the two lateral sides 102, the top side 101 and the bottom side 104 and may be opposed to the outer side 103. The outer side 103 may be connected to the two lateral sides 102, the top side 101, the bottom side 104 and may be opposed to the body side 105.

When connected, theses six sides or regions define an interior compartment called the body into which cargo such as books, food, etc. can be stowed. It is understood that this region may be subdivided into or complemented with a number of additional compartments or regions for keeping various items separate. Separating the two sides or regions are junctions or seams. Three junctions used later in the text are defined. The first junction 215 is defined between the top side 101 and the body side 105. The second junction 223 is defined between the lateral side 102 and the outer side 103. The third junction 225 is defined between the lateral side 102 and the body side 105. The defined junctions help readers in understanding the relative location on the body being discussed.

Although the six-side configuration of 100 is described, the backpack body can have fewer sides or regions and correspondingly fewer junctions or seams and still be within the scope of the invention. The particular six-side configuration and junctions are described herein strictly to assist the reader in understanding the embodiments of the invention.

The description of junctions 215, 223, 225 is meant to define a general transition region. One may move as many as several inches away from the first junction 225, for example, into the region of the outer side or the lateral side or anywhere along the line shown in the figure as defining the junction, and still be within the scope of invention.

Each shoulder strap 110 is connected at a junction 215 of the top side 101 and the body side 105, extending along the corresponding lateral side 102, threaded through the lower D-ring 325 (with respect to the bag being worn by the user), extending across the body side 105 and threaded through the D-ring 326 which may be higher than the D ring 325. The strap 110 may extend along the lateral side 102 and may terminate with a distal end 323 of the strap 110 being connected to the backpack body at a junction 223 of the lateral side 102 and the outer side 103 at a higher position than the D ring 326. When the user simply ties the two straps 110 through a buckle 111, the backpack 100 is automatically compressed and moved closer to the user's back.

Due to the heavy force acting on the distal end 323 and the D-ring 325, it is important that the points of connections be designed for durability and load-bearing functionality.

Although the D-ring 325 is located along the junction 225, and the distal end 323 is located injunction 223 in FIG. 3, their positions can vary to meet needs. However, the position of the distal end 323 should preferably be above the D-ring 325 to maximize the efficiency of the compression system when pulling the straps. Of course, the D-ring 325 can be replaced with other devices of different materials such as plastic to serve the same purpose. All of these variations in configurations such as those described above are within the scope of the invention. It is important, however, that the devices are made for durability and load-bearing functionality with smoothly rounded edges that greatly reduce the wearing of the straps while still remaining aesthetically pleasing.

Figure 4:
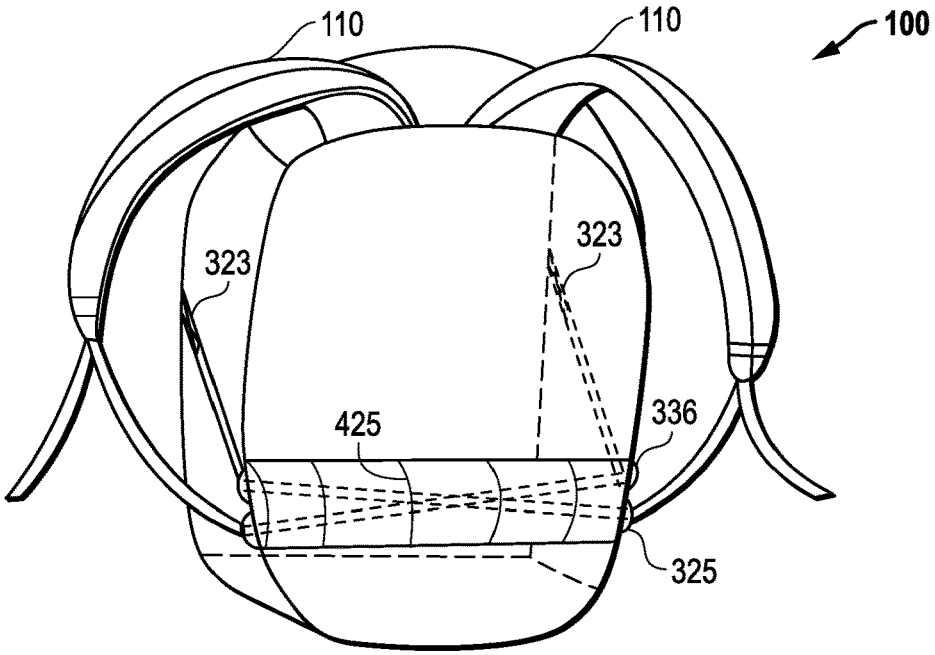
FIG. 4 is a front view of the backpack according to an alternate embodiment of the invention with an optional back support device.

In the alternative embodiment of the invention illustrated in FIG. 4, each shoulder strap 110 is connected at a junction 215 of top side 101 and the body side 105, extended along the corresponding lateral side 102, threaded through the first D-ring 335 and passed across the outside of the backpack body and threaded through the second D-ring 336 to the opposite lateral side 102 with a distal end 323 connected to the backpack body at a junction 225 of the lateral side 102 and the outer side 103. The back support device 425 is placed outside the two straps 110 and covered with a piece of material that matches the backpack to be aesthetically pleasing.

When user pulls the straps and compresses the contents of the backpack, the back support 425 provides comfortable support to user's back and also maintains the shape of the back of the backpack without being squashed if no other means, such as designed back panel discussed below, are implemented to maintain the shape of the backpack. The optional back support 425 can take the form of padding or cushion and can be filled with material such as a gel, foam, rubber or fluid or the like. Any type of padding or support device as is well-known in the art is appropriate.

Figure 5:
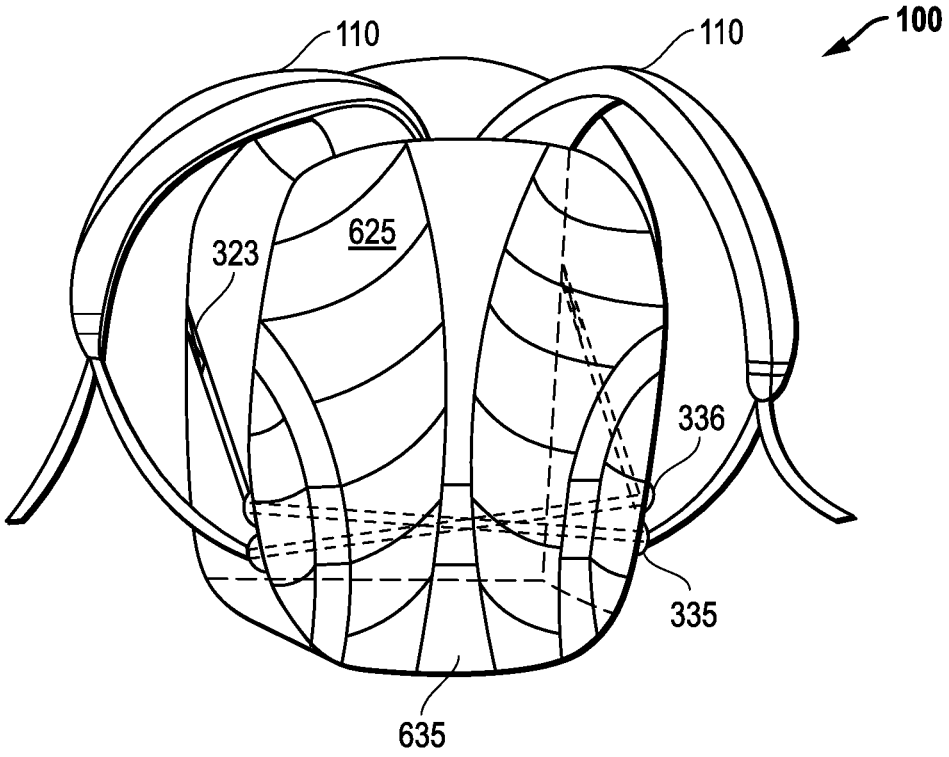
FIG. 5 illustrates a front view of the backpack according to another embodiment of the present invention.

FIG. 5 depicts an embodiment of the invention containing an optional back panel 625. The optional back panel 625 can have at least one layer. It may have a rigid layer placed inside the panel, a soft layer placed outside the rigid layer and another layer on the top of the soft layer for aesthetically pleasing look.

The rigid layer can serve two purposes when user pulls the straps and compresses the contents of the backpack. First, it maintains the shape of the back of the backpack without being squashed. Second, it provides better fit due to its flexibility that allows the back of the backpack to bend slightly toward the user's back. The rigid layer can take the form of foam, plastic or rubber or the like. Any type of padding or support device that serves the purposes as is well-known in the art is appropriate. All of these variations in configurations such as those described above are within the scope of the invention.

The soft layer can make the user comfortable to wear the backpack. The special pattern design with cavity 635 helps air circulation and reduces the temperature and in turn, reduces sweating on the user's back. In this case, the back panel 625 is sewed directly on the body side 105 from outside. The soft layer of optional back panel 625 can take the form of padding or cushion and can be filled with material such as a gel, foam, rubber or fluid or the like. Any type of padding or support device as is well-known in the art is appropriate. All of these variations in configurations such as those described above are within the scope of the invention.

FIG. 5 shows an optional back panel 625 placed on the top of the two straps 110 attached on the outer side 103 of the backpack 100. When pulling the straps through a buckle 111, the compression system brings the backpack 100 closer to the user's back. Optional back support 425 (not shown for clarity) can be added to the configuration by placing the back support 425 outside of the back panel 625. This configuration can also achieve the benefits of the invention.

The variations include a configuration where the first embodiment (FIG. 3) is modified. The second D-ring 336 is mounted inside instead of the outside of the backpack on the junction 225 of the lateral side 102 and the body side 105. Each strap is threaded through the first D ring 335 and then the second D ring 336 and secured the distal end 323 from inside to the backpack body 100 at a junction 225 of the outer side 103 and the lateral side 102.

The variations of the embodiment also include a configuration where the embodiment (FIG. 4) is modified. The back support 425 is placed inside the backpack and the back panel 625 placed on the outside of the backpack 100. In this case, the back support 425 is sewed directly on the body side 105 from inside. After that, the two straps threaded through the first D ring 336 and the second D ring 335 are attached on the back support 425.

All of the variations in configurations that include the core compression system of this invention such as described above are within the scope of the invention.

Figure 6:
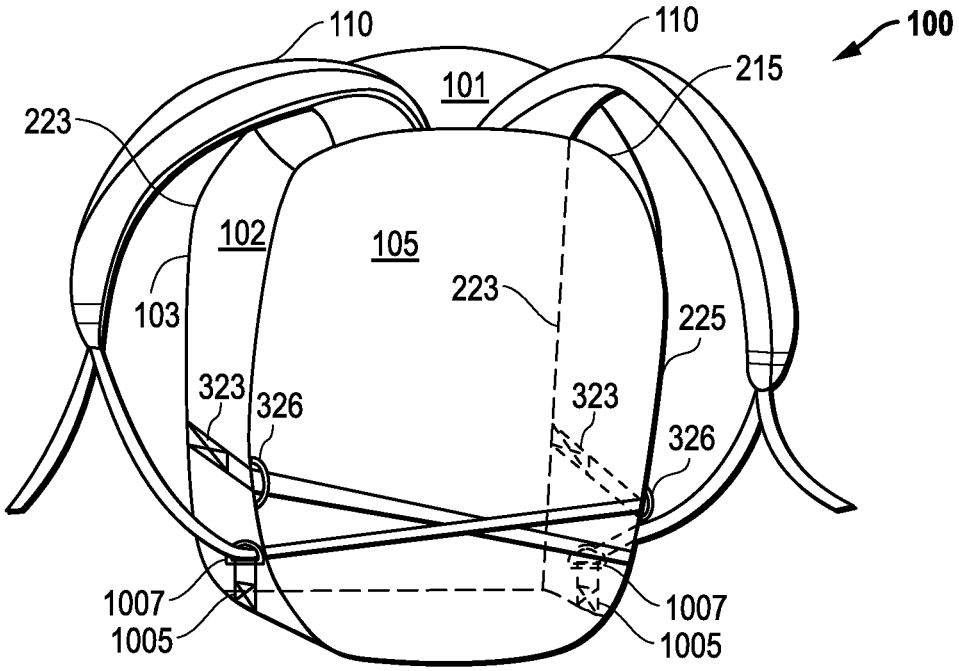
FIG. 6 illustrates a front view of the backpack according to another embodiment of the present invention.
Figure 7:
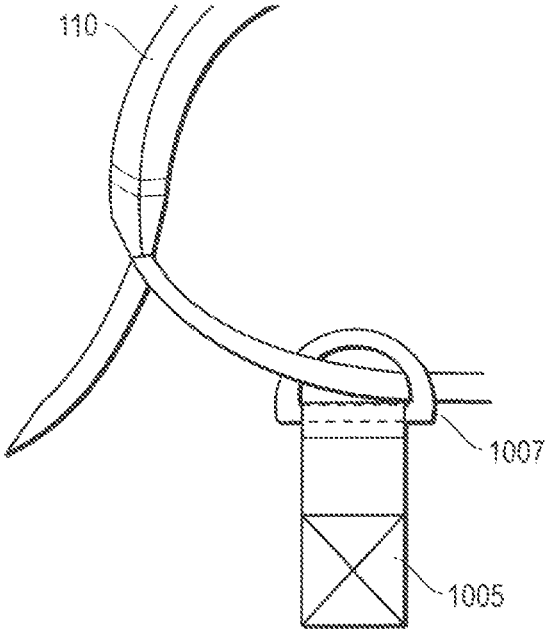
FIG. 7 illustrates a D ring of the present invention.
Figure 8:
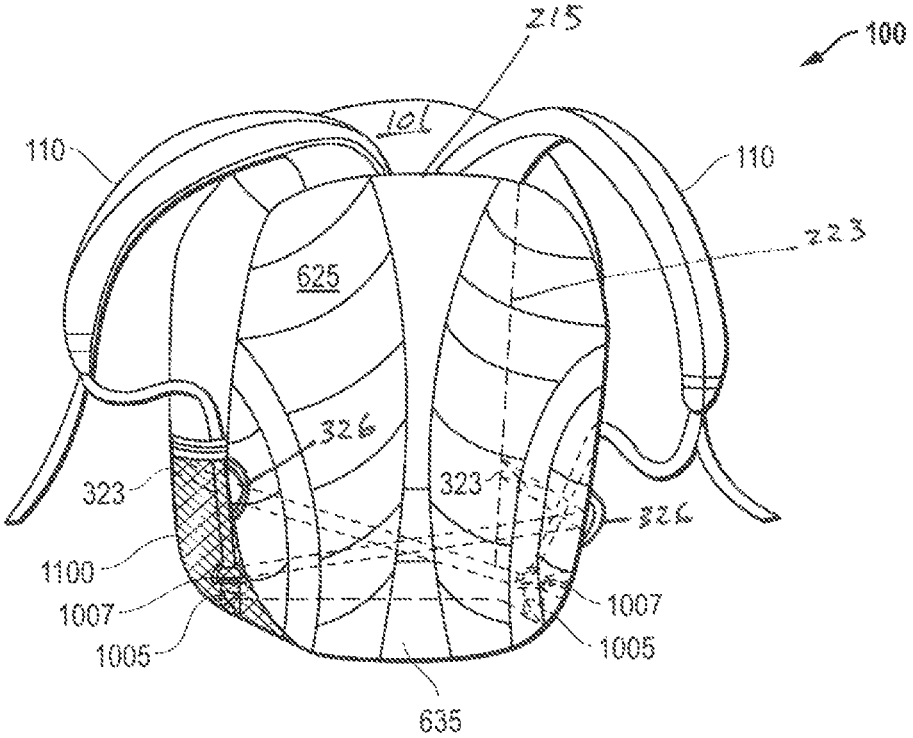
FIG. 8 illustrates a front view of the backpack with optional back panel and a pocket according to another embodiment of the present invention.

In FIGS. 6-8, backpack 100 with the compression system of the embodiment of the invention is formed by a flexible or solid material such as plastic, canvas, cloth or other suitable material and by a top side or region 101, two opposed lateral sides or regions 102, an outer side or region 103, a body side or region 105, a bottom side 104 and a pair of shoulder straps 110. The top side may be connected to the two lateral sides 102, the outer side 103 and the body side 105, and the bottom side 104 may be connected to the two lateral sides 102, the outer side 103 and the body side 105. The two lateral sides 102 may be connected to the top side 101, the bottom side 104, the body side 105 and the outer side 103. The body side 105 may be connected to the two lateral sides 102, the top side 101 and the bottom side 104 and may be opposed to the outer side 103. The outer side 103 may be connected to the two lateral sides 102, the top side 101, the bottom side 104 and may be opposed to the body side 105.

FIG. 6 illustrates a strap 1005 which may be attached to the backpack 100 on the lateral side 102 and may be positioned substantially vertically. Each shoulder strap 110 is connected at a junction 215 of the top side 101 and the body side 105, extending along the corresponding lateral side 102, threaded through a D-ring 326 or aperture, extending across the outside of the backpack body side 105 and threaded through the D-ring 1007 on the opposite side. The strap 110 may extend along the lateral side 102 and may terminate with a distal end 323 of the strap 110 being connected to the backpack body at a junction 223 of the lateral side 102 and the outer side 103 at a higher position than the D ring 1007. When the shoulder strap 110 is tightened, the backpack 100 is compressed and pulls the backpack closer to the back of the user, providing back support for the user.

FIG. 7 illustrates the single D ring 1007 connected to the strap 1005 and illustrates the shoulder strap 110 extending through the single D ring 1007. Due to the heavy force acting on the D-ring, it is important that the points of connections be designed for durability and load bearing functionality. In addition, since the D ring is located near the bottom of the lateral side, it makes easier for the user to wear the straps.

FIG. 8 depicts an embodiment of the invention containing an optional back panel 625 and a pocket 1100. Some numbers and features are not shown for clarity.

The pocket 1100 may be netting or other types of material that can match the color, material or style of the backpack. The pocket 1100 design serves two primary purposes. First, it can be used to carry small objects, such as water bottle, etc. Second, it covers the straps for aesthetically pleasing look.

Figure 9:
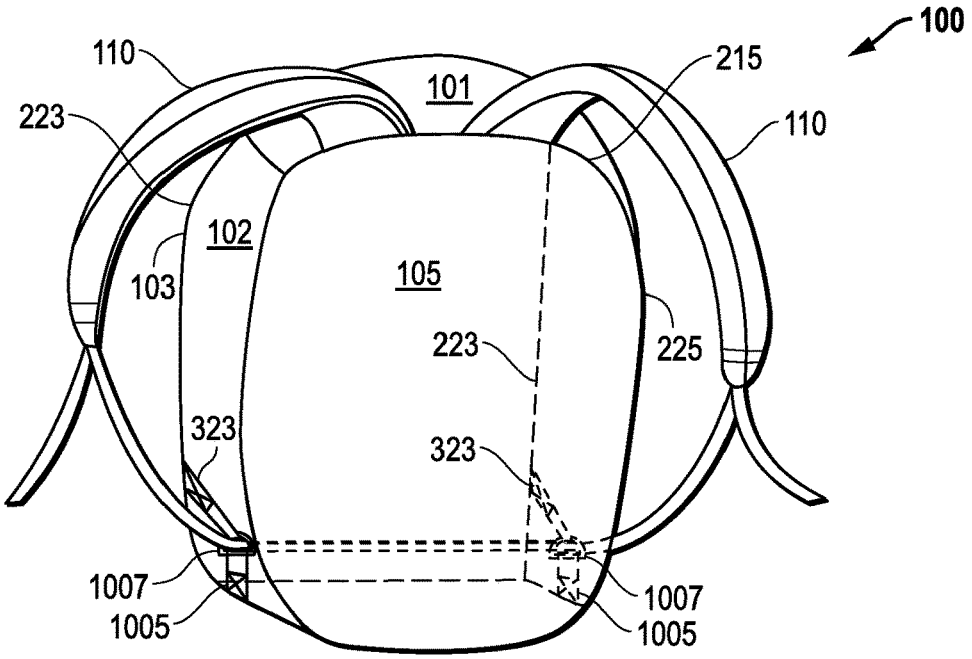
FIG. 9 illustrates a front view of the backpack according to another embodiment of the present invention.
Figure 10:
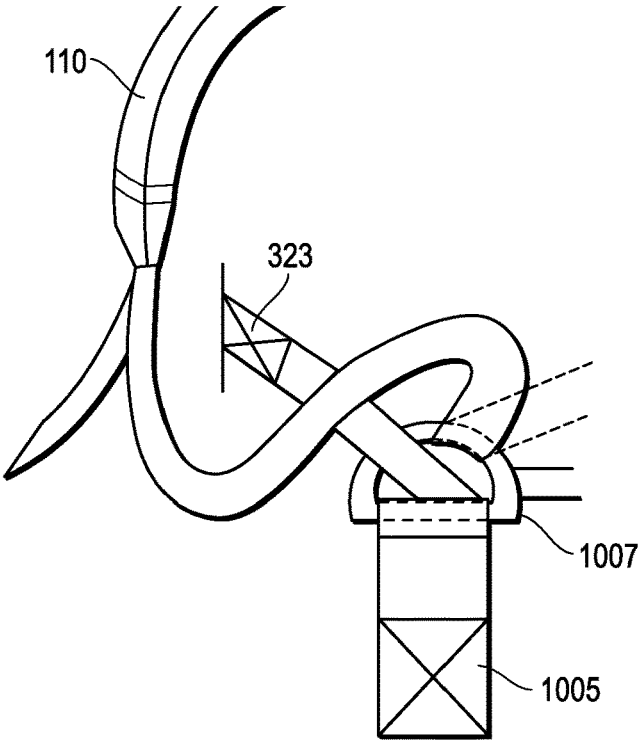
FIG. 10 illustrates a D ring of the present invention.
Figure 11:
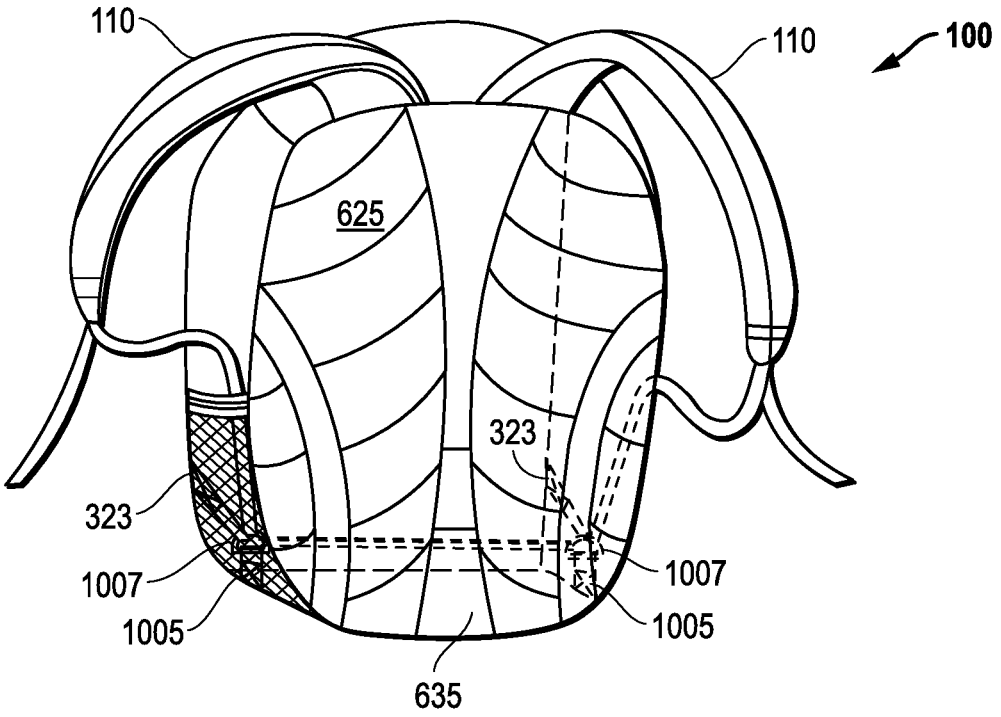
FIG. 11 illustrates a front view of the backpack with optional back panel and a pocket according to another embodiment of the present invention.

In FIGS. 9-11, backpack 100 with the compression system of the embodiment of the invention is formed by a flexible or solid material such as plastic, canvas, cloth or other suitable material and by a top side or region 101, two opposed lateral sides or regions 102, an outer side or region 103, a body side or region 105, a bottom side 104 and a pair of shoulder straps 110. The top side may be connected to the two lateral sides 102, the outer side 103 and the body side 105, and the bottom side 104 may be connected to the two lateral sides 102, the outer side 103 and the body side 105. The two lateral sides 102 may be connected to the top side 101, the bottom side 104, the body side 105 and the outer side 103. The body side 105 may be connected to the two lateral sides 102, the top side 101 and the bottom side 104 and may be opposed to the outer side 103. The outer side 103 may be connected to the two lateral sides 102, the top side 101, the bottom side 104 and may be opposed to the body side 105.

FIG. 9 illustrates that the shoulder strap 110 from each side extends through the inside cavity of the backpack 100. A strap 1005 may be attached to the backpack 100 on the lateral side 102 and may be positioned substantially vertically. Each shoulder strap 110 is connected at a junction 215 of the top side 101 and the body side 105, extending along the corresponding lateral side 102, threaded through the D-ring 1007, extending across the inside of the backpack body side 105 and threaded through the D-ring 1007 on the opposite side. The strap 110 may extend along the lateral side 102 and may terminate with a distal end 323 of the strap 110 being connected to the backpack body at a junction 223 of the lateral side 102 and the outer side 103 at a higher position than the D ring 1007. When the shoulder strap 110 is tightened, the backpack 100 is compressed and pulls the backpack closer to the back of the user, providing back support for the user.

FIG. 10 illustrates one shoulder strap 110 extending through the single D ring 1007 and another should strap 110 passing through the D-ring 1007 that may terminate with a distal end 323 of the strap 110 being connected to the backpack body at a junction 223 of the lateral side 102 and the outer side 103 at a higher position than the D ring.

FIG. 11 depicts an embodiment of the invention containing an optional back panel 625 and a pocket 1100.

Figure 12:
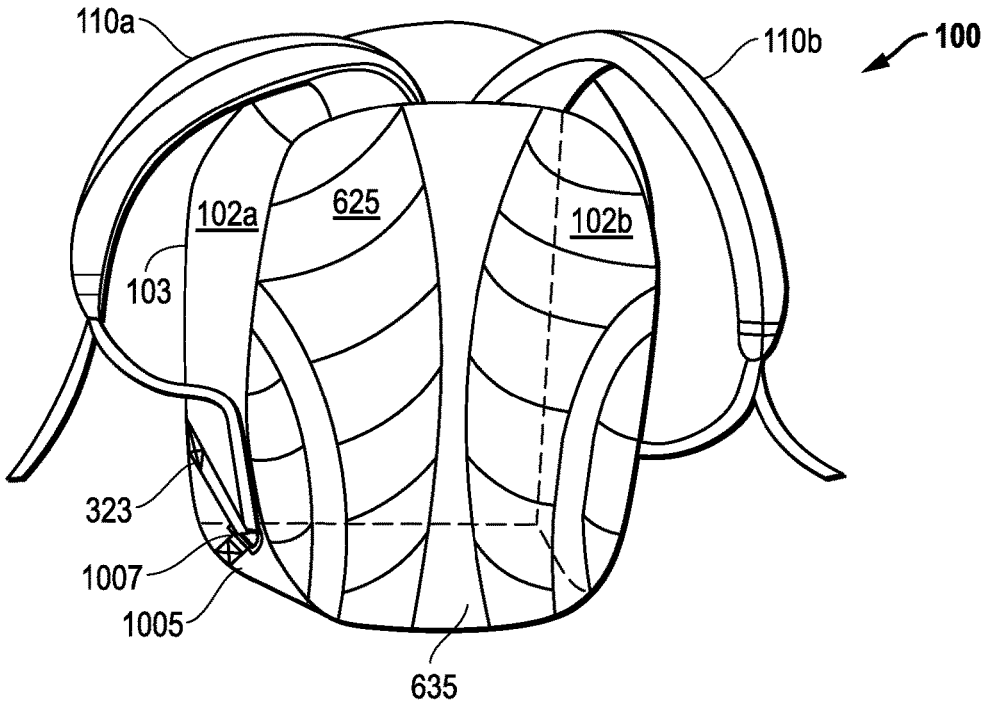
FIG. 12 illustrates a front view of the backpack with optional back panel according to another embodiment of the present invention.
Figure 13:
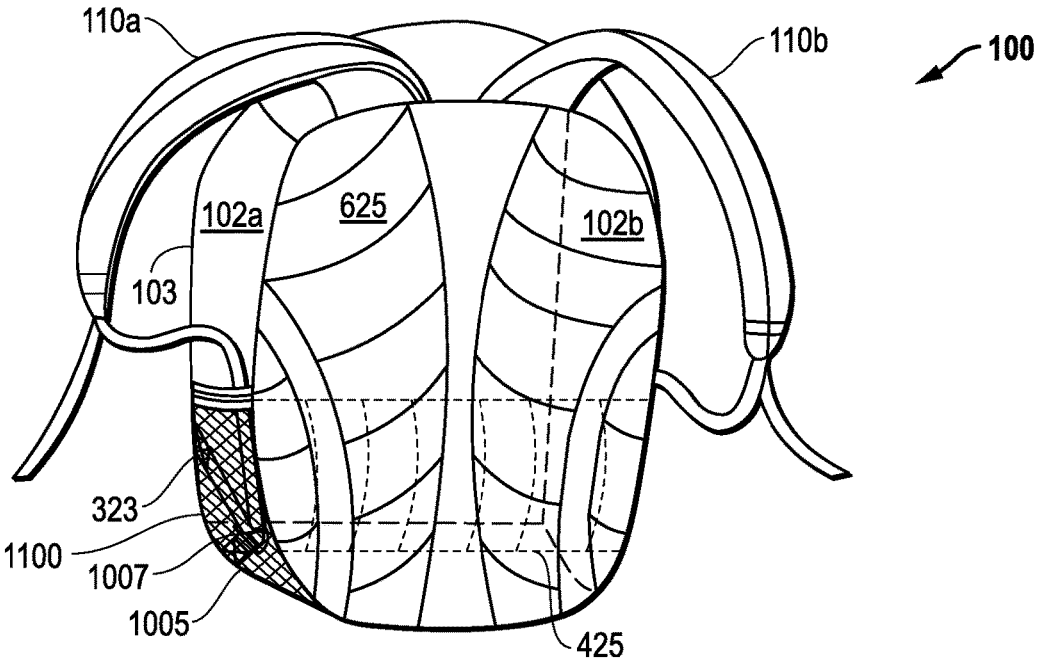
FIG. 13 illustrates a front view of the backpack with an optional back panel and a back support.

In FIGS. 12-13, backpack 100 is another embodiment wherein the top panel 101, the first lateral panel 102*a* and second lateral panel 102*b*, the outer panel 103, the body panel 105, the bottom panel 104, and the first shoulder support member 110*a* and second shoulder support member 110*b* are equivalent to the top side or region 101, the two opposed lateral sides or regions 102, the outer side or region 103, the body side or region 105, the bottom side 104 and the pair of shoulder straps 110 of backpack 100 in FIGS. 1-11. are formed by a flexible or solid material such as plastic, canvas, cloth or other suitable material.

FIG. 12 depicts an embodiment of backpack 100 also containing an optional back panel 625. Optional back panel 625 is attached to the outside of body panel 105. A strap 1005 is attached vertically or at an angle on the first and second lateral panel 102*a*, 102*b*. Support attachment 1007, equivalent to D-ring 1007 in FIG. 7 is attached to strap 1005. First shoulder support member 110*a* has one end connected to a junction 215 between top panel 101 and body panel 105. The other end of first shoulder support member 110*a* slides through the support attachment 1007 located on first lateral panel 102*a* and attaches to the first lateral panel 102*a*. Second shoulder support member 110*b* also has one end attached to junction 215, and the other end sliding through the support attachment 1007 located on second lateral panel 102*b* and attaches to the second lateral panel 102*b*.

FIG. 13 depicts an embodiment of backpack 100 as in FIG. 12, further comprising an optional back support 425, and pocket 1100. The optional back support 425 is attached to the body panel 105 from inside of the backpack 100. The optional back panel 625 is attached to the body panel 105 from outside of the backpack 100. The pocket 1100 may be netting or other types of material that can match the color, material or style of the backpack.

When the first and second support members 110*a*, 110*b* are tightened, the weight of the backpack exerts pulling pressure on the other ends attached to the lateral panels 102*a*, 102*b*, of the two shoulder members, resulting in the contents of the backpack, the back support 425, and the back panel 625 are pulled closer to the back of the user. As a result, backpack 100 is compressed towards the user. In addition, the back panel 625 is bent slightly toward the user to better fit the shape of the user's entire back. The variations of the embodiment also include a configuration that the other ends attached to the lateral panels 102*a*, 102*b*, of the two shoulder members, are connected together to enhance the durability of the design.

As a well-known art, the holes left by the straps when passed through the body of the backpack need to be covered with appropriate material of the backpack for functionality and aesthetically pleasing look.

The variations of the embodiment described above include a configuration that connects the two distal ends 323 together to enforce the durability of the design, which is not shown for clarity. The variations also include a configuration that has an optional back support device. All of the variations in configurations that include the core compression system of this invention such as described above, are within the scope of the invention.

While the preferred embodiments of the invention have been described, modification can be made and other embodiments may be devised without departing from the spirit of the invention and the scope of the appended claims.

What is claimed is:

1. A backpack comprising:

a backpack body having a body panel, a top panel, a bottom panel, a first lateral panel, a second lateral panel, and an outer panel;

a first support attachment on or about the first lateral panel;

a second support attachment on or about the second lateral panel;

wherein the first and second support attachments are designed for load-bearing functionality;

a first shoulder support member, wherein the first shoulder support member has a first end connected to a junction of the top panel and the body panel, and a second end slidably passing through the first support attachment and attaching to the first lateral panel on or about a junction of the first lateral panel and the outer panel;

a second shoulder support member, wherein the second shoulder support member has a first end connected at a junction of the top panel and the body panel, and a second end slidably passing through the second support attachment and attaching to the second lateral panel on or about a junction of the second lateral panel and the outer panel, wherein the first ends of the first shoulder support member and the second shoulder support member are not connected; and wherein the position of the first and second ends is higher than the corresponding first and second support attachments in the lateral panels such that the backpack body can be compressed downward by tightening the first and second shoulder support members.

2. The backpack of claim 1, wherein the first support attachment is on a junction of the first lateral panel and the body panel, and the second support attachment is on a junction of the second lateral panel and the body panel.

3. The backpack of claim 1, wherein the first and second support attachments are comprised of a strap and a ring.

4. The backpack of claim 1, further comprising at least one of a back panel attached to the body panel of the backpack, wherein the back panel is formed such that the shape of the backpack can be maintained with flexibility and is capable of bending toward a user's back when compressed, or a back support attached to the body panel of the backpack and capable to provide fit and support to the user's back.

5. A backpack comprising:

a backpack body having a body panel, a top panel, a bottom panel, a first lateral panel, a second lateral panel, and an outer panel;

a first aperture on or about the first lateral panel;

a second aperture on or about the second lateral panel;

wherein the first and second apertures are designed for load-bearing functionality; and a first and second shoulder support member, wherein each shoulder support member has a first end connected at a junction of the top panel and the body panel, and a second end slidably passing through the first or second aperture and attaching to the first or second lateral panel on or about a junction of the first lateral panel and the outer panel or on or about a junction of the second lateral panel and the outer panel, wherein the position of the first and second ends is higher than the corresponding first and second apertures in the lateral panels such that the backpack body can be compressed downward by tightening the first and second shoulder support members, and wherein the first ends of the first shoulder support member and the second shoulder support member are not connected.

6. The backpack of claim 5, wherein the first and second aperture further comprise a ring integral with the first and second lateral panel to provide load bearing functions and support.

7. The backpack of claim 5, further comprising at least one of a back panel attached to the body panel of the backpack, wherein the back panel is formed such that the shape of the backpack can be maintained with flexibility to bend toward the user's back when compressed, or a back support attached to the body panel of the backpack to provide fit and support to the user's back.

8. A backpack comprising:

a backpack body having a body panel, a top panel, a bottom panel, a first lateral panel, a second lateral panel, and an outer panel;

a first support attachment on or about the first lateral panel;

a second support attachment on or about the second lateral panel;

wherein the first and second support attachments are designed for load-bearing functionality; and a first and second shoulder support member, wherein each shoulder support member has a first end connected at a junction of the top panel and the body panel, and a second end slidably passing through the first or second support attachment and attaching to the first or second lateral panel on or about a junction of the first lateral panel and the outer panel or on or about a junction of the second lateral panel and the outer panel, wherein the position of the first and second ends is higher than the corresponding first and second support attachments in the lateral panels such that the backpack body can be compressed downward by tightening the first and second shoulder support members, and wherein the first ends of the first shoulder support member and the second shoulder support member are not connected.

9. The backpack of claim 8, wherein the first and second attachments further comprise a ring integral with the first and second lateral panel to provide load bearing functions and support.

10. The backpack of claim 8, further comprising at least one of a back panel attached to the body panel of the backpack, wherein the back panel is formed such that the shape of the backpack can be maintained with flexibility to bend toward the user's back when compressed, or a back support attached to the body panel of the backpack to provide fit and support to the user's back.

* * * * *